United States Patent [19]

Cooney

[11] 4,380,478

[45] Apr. 19, 1983

[54] APPARATUS AND METHOD FOR CLEANING PAINT ROLLER COVERS

[76] Inventor: James J. Cooney, 763 Sapphire St., San Diego, Calif. 92109

[21] Appl. No.: 308,369

[22] Filed: Oct. 5, 1981

[51] Int. Cl.[3] ..... B08B 3/04

[52] U.S. Cl. ..... 134/38; 68/213; 134/117

[58] Field of Search ..... 134/38, 117, 149; 68/213

[56] References Cited

U.S. PATENT DOCUMENTS

| | | | |
|---|---|---|---|
| 2,819,483 | 1/1958 | Macaulay | 68/213 X |
| 3,421,527 | 1/1969 | Dettman | 134/149 X |
| 3,431,574 | 3/1969 | Mathieu | 68/213 X |
| 4,126,484 | 11/1978 | Monteiro | 134/38 X |
| 4,155,230 | 5/1979 | Lacher | 68/213 |

FOREIGN PATENT DOCUMENTS

| | | | |
|---|---|---|---|
| 793180 | 4/1958 | United Kingdom | 15/104.92 |

*Primary Examiner*—Marc L. Caroff
*Attorney, Agent, or Firm*—Paul A. Weilein

[57] ABSTRACT

A paint roller cover having an outer annular absorbent layer is plugged at one end and inserted through one end of an open-ended cylindrical casing into a snug position within the casing. In one embodiment, said one end of the casing has a closure cap adapted for connection to a supply source of pressurized liquid for forced flow through the absorbent layer and discharge out of the other end of the casing. In another embodiment, said one end of the casing is insertable into piston-cylinder relationship with the open upper end of a container substantially filled with a cleaning liquid. Relative axial movement of the casing and container operates to force the liquid through the absorbent layer. An important feature of the invention is that during endwise movement of the cover into the cleaning position, the material of the absorbent layer will be angularly deflected into a position which is conducive to the uniform distribution of the axial flow of cleaning liquid within the annular layer. Removal of the clean roller cover from the casing is facilitated by moving it in an endwise direction out of the other end of the casing, rather than by a reverse movement out of said one end of the casing, which would tend to induce a wedging action by the absorbent material.

20 Claims, 6 Drawing Figures

APPARATUS AND METHOD FOR CLEANING PAINT ROLLER COVERS

PRIOR ART

In the prior art, a number of patents disclose several different concepts for the cleaning of hollow cylinder paint roller covers. The closest art known to applicant comprises the following patents:

U.S. Pat. No. 276,179 Apr. 24, 1883
U.S. Pat. No. 316,457 Apr. 28, 1885
U.S. Pat. No. 2,704,931 Mar. 29, 1955
U.S. Pat. No. 2,766,603 Oct. 16, 1956
U.S. Pat. No. 2,831,488 Apr. 22, 1958
U.S. Pat. No. 3,075,534 Jan. 29, 1963
U.S. Pat. No. 3,421,527 Jan. 14, 1969
U.S. Pat. No. 3,431,574 Mar. 11, 1969
U.S. Pat. No. 3,755,840 Sept. 4, 1973
U.S. Pat. No. 4,061,153 Dec. 6, 1977
U.S. Pat. No. 4,155,230 May 22, 1979

BACKGROUND OF THE INVENTION

The present invention relates generally to the field of cleaning apparatus.

The present invention is primarily concerned with an improved apparatus and method for the cleaning of paint roller covers of the type in which a more or less flexible tubular liner of plastic, cardboard or other material is provided with a surrounding outer annular layer of absorbent fabric material that usually contains some type of fibers. Provision is usually made to enable these covers to be removed from the paint roller device, either for replacement or for the purpose of cleaning before they can be used again.

In the prior art the cleaning devices for the roller covers are classifiable into two general classes. One of these classes is exemplified, for example, by U.S. Pat. Nos. 2,831,448; 3,431,574; and 4,061,153 wherein the cover is arranged to be openly confined within a closed container, and water or other paint solvent is flowed over the outer and inner exposed surfaces of the cover. The other class is exemplified by U.S. Pat. No. 4,155,230 which discloses an arrangement in which the cylindrical roller cover of absorbent material fits snugly into a cylindrical casing, and a plug is utilized to close the hollow center of the roller. The cleaning liquid is forced into one end of the casing and flows axially through only the absorbent material and out the other end of the casing.

The present invention seeks to provide an improved structure and method over that shown in U.S. Pat. No. 4,155,230 and includes a number of features which overcome a number of inherent operating disadvantages of the structural arrangement disclosed in this patent, and which may be noted as including:

1. The roller cover in this patent can only be inserted and removed from the cleaning liquid discharge end of the casing. Thus, during insertion of the cover into the snug fitting casing, the fibers of the absorbent layer will be angularly rearwardly deflected along the casing wall in such manner that there will be a tendency to direct the pressurized liquid supplied to the inlet end of the casing in an outward direction towards the casing wall, and by this action tend to impede the liquid flow and cause a non-uniform flow generally through the absorbent layer. Since provision is only made for removing the roller cover from the discharge end of the casing, in a direction opposed to the direction of insertion, the deflected fabric texture of the roller cover will tend to wedgingly oppose and make removal of the roller cover very difficult.

In the present invention the above noted disadvantages are minimized and corrected by providing an arrangement which permits the roller cover to be inserted into the casing at the liquid inlet end, and removed from the discharge end of the casing. Thus, the fabric of the absorbent material will be deflected along the casing wall in a direction towards the inlet for the supply of pressurized cleaning liquid, and will thus tend to guide the axial flow away from the casing wall and produce a more uniformly distributed axial flow of liquid through the layer of absorbent material. Moreover, in arranging for the removal of the cover from the discharge end of the casing in the same axial direction in which the cover was inserted, the wedging effect will be entirely eliminated.

2. A further disadvantage of the noted patent structure results from the provision of circumferentially spaced liquid outlet openings which are in communication with the adjacent end face of the annular layer of absorbent material of the roller cover. These outlet openings thus tend to separate the liquid flow at this end of the roller cover into discrete flow channels which are separated by non-flow portions which will not therefore be cleaned.

In the present invention the fluid at the discharge end of the roller absorbent layer is through an annular substantially unobstructed opening such that all portions of the roller cover at this end will be effectively subjected to the cleaning liquid.

3. The noted patent also has the further disadvantage in that the casing is restricted to use in a location where it can be connected at its inlet end by means of a connection fitting with a hose, faucet or the like to provide a pressurized cleaning liquid source, such as water.

In the present invention a unique arrangement is provided in which the casing with the inserted roller cover therein can be inverted and utilized in a piston-cylinder relationship with an open ended container for the cleaning liquid to force the cleaning liquid through the absorbent layer of the roller cover by relatively moving the casing into the container.

SUMMARY OF THE INVENTION

Having in mind the inherent disadvantages of the prior known cleaning devices for paint roller covers, it is one object of the present invention to provide an improved apparatus and method for guidingly forcing a cleaning liquid axially through the annular absorbent layer of a paint roller cover.

A further object of the herein described invention is to provide apparatus for cleaning a paint roller cover having an annular layer of absorbent material in which endwise movement of the cover into a cleaning position within a snug fitting casing will result in the deflection of the fibers of the absorbent material into an angular position such that, when a pressurized cleaning liquid is applied to one end of the cover, the liquid will tend to be uniformly distributed transversely of the layer.

A further object is to provide a cleaner for a paint roller cover according to the previous object in which the cleaned cover is removable from the cleaning position in the casing by axial movement in the same direction as it is moved into the cleaning position in order to avoid a wedging action by the angularly deflected fibers during removal.

Another object is to provide cleaning apparatus in the form of a cylindrical casing for receiving the roller cover into a cleaning position therein, the casing being connectable at one end with a removably attached closure cap adapted for connection with a source of pressurized cleaning liquid.

Still another object is to provide cleaning apparatus having a cylindrical casing for snugly receiving endwise therein through one open end, a roller cover into a cleaning pssition, and in which the one end of the casing, upon being inverted, is adapted to be inserted into a piston-cylinder relationship with the upper open end of a container of cleaning liquid, and upon relative movment of the casing into the container will force cleaning liquid through the roller cover.

Further objects and advantages of the invention will be brought out in the following part of the specification, wherein detailed description is for the purpose of fully disclosing the several embodiments of the invention without placing limitations thereon.

BRIEF DESCRIPTION OF THE DRAWINGS

Referring to the accompanying drawings, which are for illustrative purposes only.

DESCRIPTION OF THE PREFERRED EMBODIMENTS

Figure 1:
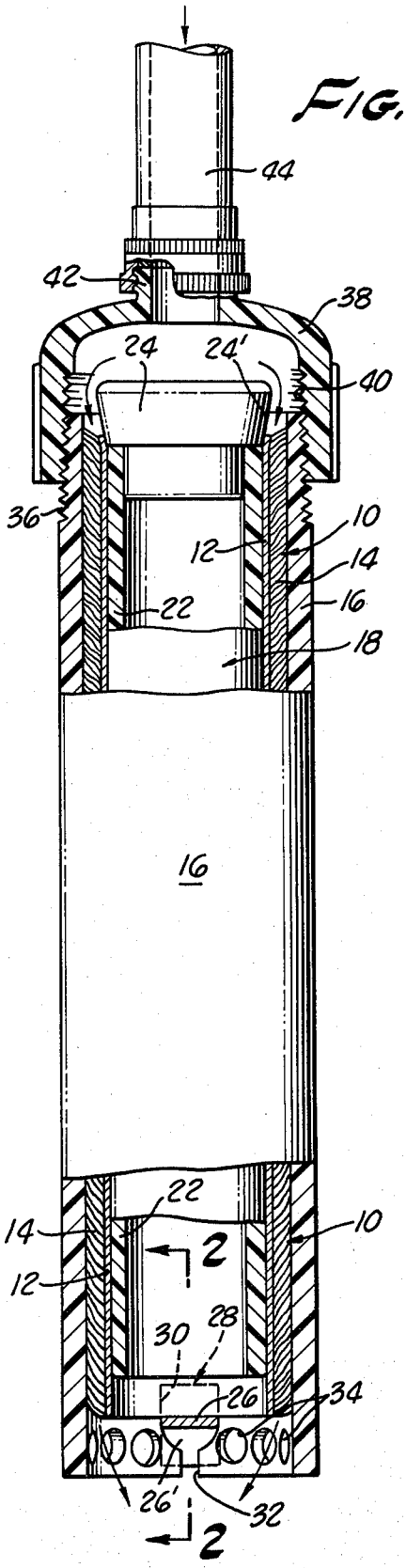
FIG. 1 is an elevational view of one embodiment of the invention, with cut away end portions in section to disclose important features of construction, and the attachable end closure cap for connecting the apparatus with an independent source of pressurized liquid solvent.

Referring more particularly to the drawings, for illustrative purposes, the present invention is concerned with unique apparatus and method for cleaning paint roller covers as generally indicated in FIG. 1 by the numeral 10. Usually, such covers comprise a more or less rigid tubular liner 12 of cardboard, plastic, or other suitable material which supports a surrounding annular layer of a generally fibrous absorbent material, as indicated by the numeral 14. The cover 10 is arranged to be snugly embraced between the wall surfaces of an exterior cylindrical casing 16 and an inner cylindrical insert 18 which coact to form a restricted annular passage for the cover and guidingly direct a cleaning solvent introduced at one end of the passage through the annular layer for discharge at the other end of the casing.

Figure 4:
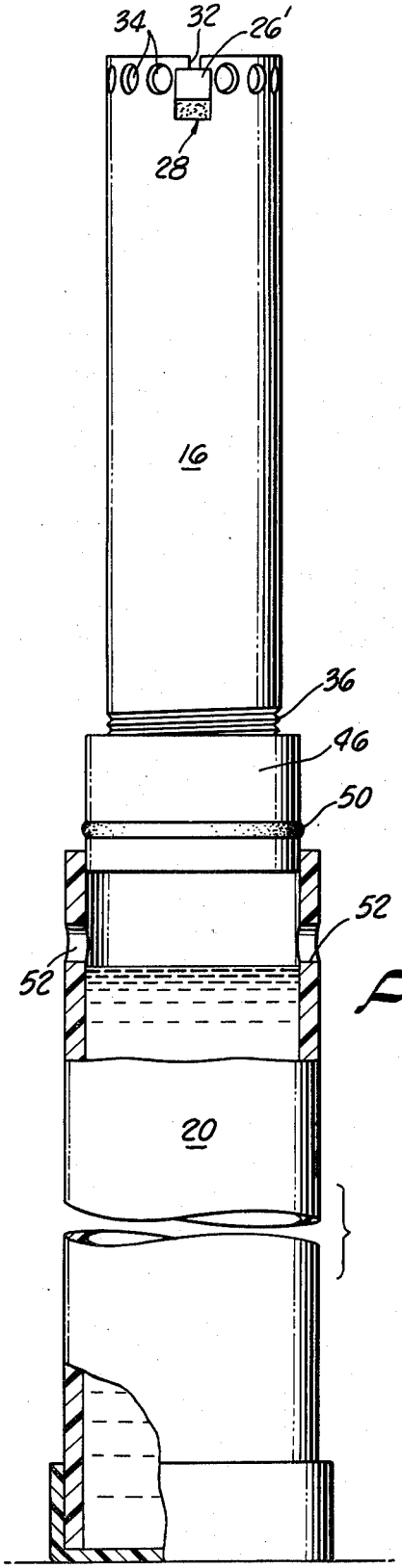
FIG. 4 is an elevational view of another embodiment of the invention, having cut away portions, and showing the manner in which the casing of the embodiment shown in FIG. 1 may be combined with a container for liquid solvent to provide a piston-cylinder relationship.

In one embodiment of the invention, as shown in FIG. 1, the casing 16 is arranged at said one end for connection with a remote source of supply for a pressurized liquid such as water or other appropriate solvent. In another embodiment, as shown in FIG. 4, the casing 16 is arranged to be endwise inserted through the open end of a solvent container 20 in a manner to provide a piston-cylinder relationship wherein, upon axial relative movement of the casing into the container, the solvent liquid will be axially forced through the annular absorbent layer 14 of the roller cover in the casing 16.

More specifically, referring again to FIG. 1, the insert 18 is shown as being formed of an elongate tubular member 22 of plastic or other suitable material, and has an outer diameter such that the insert may be slidingly inserted endwise into one end of the liner 12 and moved to a seated position in which a stopper end portion 24 engages around its bevelled peripheral edge surface 24' with the adjacent end edge of the tubular liner 12 and forms a closure against the entrance of liquid solvent into this end of the liner. While the stopper portion is disclosed as being constructed as a separate element from the tubular member 22, it will be appreciated that the stopper, if desired, may be integrally formed with the tubular member.

The roller cover that is to be cleaned is first prepared by inserting the insert 18 endwise into one end of the liner 12 and then axially moved until the stopper portion 24 sealingly engages with the associated end of the liner. The assembled cover and insert are then inserted into a cleaning position within the casing 16 by the endwise insertion of the non-stoppered end of the roller cover into said one end of the casing, and by axial movement causing the cover to move into a predetermined cleaning position against a stop bar 26 at the other end of the casing 16.

A feature of the arrangement as thus far described resides in the utilization of a structure which permits the roller cover to be inserted at one end of the casing 16, the end at which the pressurized solvent is to be applied, and that in the process of inserting the cover, the fabric of the annular absorbent layer 14 will be angularly deflected into a position, as shown in FIG. 1, in which the material fibers will tend to cause the pressurized solvent to axially flow through the absorbent layer in a more uniformly transversely distributed manner.

Removal of the cleaned roller cover from the casing 16 is also facilitated in the disclosed arrangement by the use of a structure which permits the cleaned cover to be removed in the same direction in which it is inserted into the casing 16. Thus, the cleaned cover will be removed from the other end of the casing, from that into which it was inserted. Accordingly, any wedging action by the deflected material of the absorbent layer will be avoided.

Figure 2:
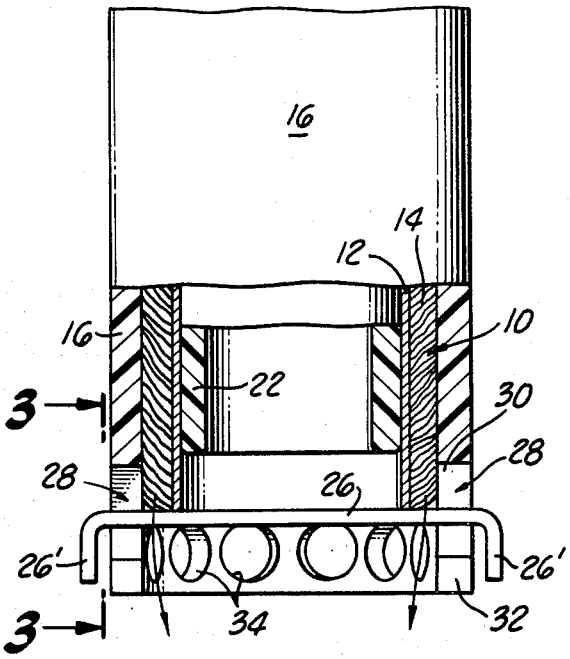
FIG. 2 is an enlarged fragmentary sectional view, taken substantially on line 2—2 of FIG. 1 to show details of the stop bar for positioning the roller cover in cleaning position.
Figure 3:
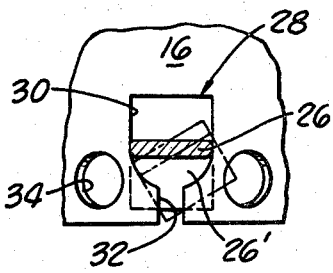
FIG. 3 is a detailed fragmentary view, partly in section, as seen along line 3—3 of FIG. 2, to show the manner in which the stop bar may be released.

In order to enable removal of the roller cover 10 and the associated insert 18 as a unit assembly, as best shown in FIGS. 2 and 3, the stop bar 26 is releasably supported at the other end of the casing 16. It will be seen that the stop bar 26 is fabricated from a flat strip of material and formed with similarly deflected end portions 26'. As shown in FIG. 3, each end of the bar 26 is supported inwardly of the adjacent end portion 26' within a casing wall slot, as generally indicated at 28, this wall slot having a relatively wide inner portion 30 which is progressively narrowed to a restricted neck portion 32 which opens into the bottom end edge of the casing. As thus arranged, the slot will seatingly support each end of the stop bar 26 in a plane at right angles to the longitudinal axis of the casing, and in a position extending generally transversely across the longitudinal passage within the casing. As shown in FIG. 3, the bar may be removed simply by transversely tilting the bar into an edgewise position which will permit it to be removed through the neck portions 32 of the slots. As best shown in FIG. 2, the bar 26 is so positioned that it will support the roller cover in a cleaning position such that the associated end of the roller cover will be positioned above a plurality of circumferentially spaced flow outlet openings 34 for a purpose which will subsequently appear.

The structure as thus far described is susceptible of use with both embodiments of the invention, and for this purpose, the opposite end of the casing 16 is formed with external connection threads 36.

In utilizing the previously described structure according to the embodiment disclosed in FIG. 1, a closure cap 38 is attached by means of internal threads 40 which are threadedly engaged with the threads 36 of the casing. This cap is formed with a threaded flow inlet nipple 42 which permits connection thereto of a supply hose 44 for a suitable pressurized solvent from a remote source for the purpose of flow through the absorbent layer of the roller cover 10 which has been previously inserted along with the insert 18 into a cleaning position in the manner previously described within the casing 16. The cleaning solvent will be effectively conducted through the absorbent layer of the cover and discharged in a substantially unimpeded flow from the other end of the casing. Upon completion of the cleaning operation, the cap 38 is removed, and the stop bar released, whereupon by the application of pressure against the stopper portion 24, the insert and associated roller cover may be moved sufficiently within the casing so that the other end of the roller cover will project from the casing sufficiently to be manually grasped and pulled completely out of the casing.

In order to clean the roller cover according to the embodiment as disclosed in FIG. 4, the previously described structure is modified so that it may be utilized as a piston in a piston-cylinder relationship with the solvent container 20 to provide a self-contained supply of solvent liquid and by the piston-cylinder action force this liquid through the absorbent layer of the roller cover. For this purpose, an end collar 46 is provided with internal threads 48 at one end for attaching threaded engagement with the threads 36 of the casing 16. This collar mounts a circumferentially extending external sealing ring 50 which permits the casing to be utilized in a piston relationship with the cylindrical container 20.

Figure 5:
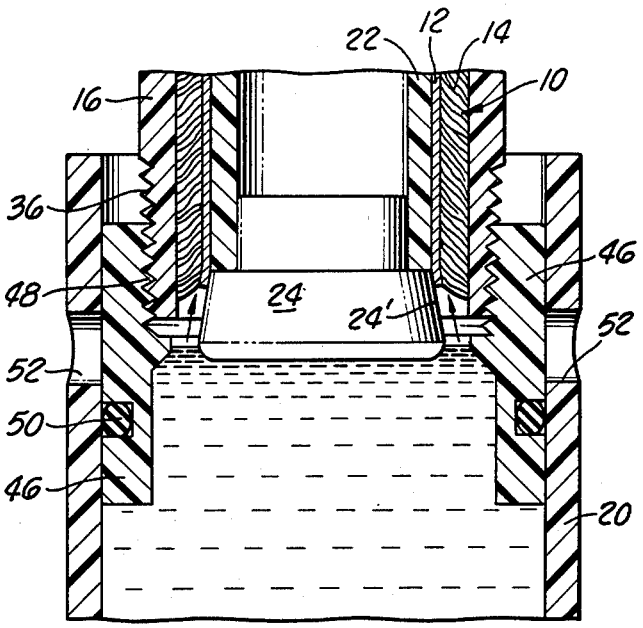
FIG. 5 is an enlarged fragmentary sectional view showing the operative relationship of the piston and cylinder forming parts in section, when in extended position.
Figure 6:
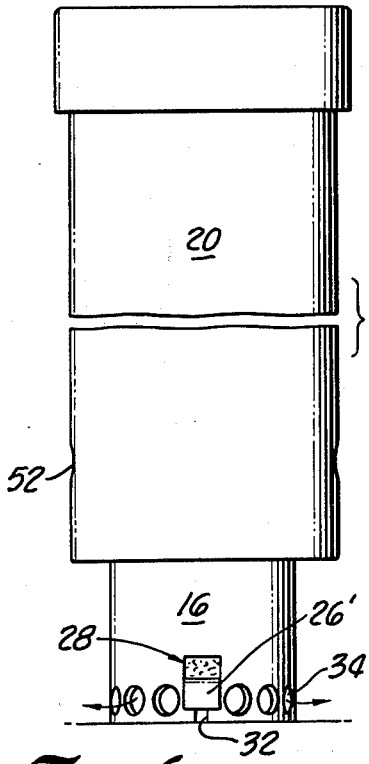
FIG. 6 is an elevational view showing the piston and cylinder forming part in retracted position.

As shown in FIG. 4, the container 20 is open at its upper end, and inwardly spaced from this end the wall of the container is provided with one or more wall openings 52 which serve to determine the maximum obtainable level of liquid within the container. As shown in FIG. 5, as soon as the piston forming end of the casing 16 is moved downwardly until the sealing ring 50 reaches a position below the openings 52, further movement of the piston will be operative to force liquid from the container upwardly through the absorbent layer of the roller cover for discharge from the other end of the casing 16. As best disclosed in FIG. 6 and to facilitate movement of the casing-piston into the cylinder, the parts may be inverted into the position shown in FIG. 6 in which the outer end of the casing 16 may be engaged against an underlying surface, and with the container 20 in an elevated position. It will be noted that discharge of the cleaning liquid will now be through the openings 34.

From the foregoing description and drawings, it will be clearly evident that the delineated objects and features of the invention will be accomplished.

Various modifications may suggest themselves to those skilled in the art without departing from the spirit of the invention, and hence, I do not wish to be restricted to the specific forms shown or uses mentioned, except to the extent indicated in the appended claims.

I claim:

1. In combination, cleaning apparatus and a cylindrical paint roller cover of the type having a surrounding outer annular layer of absorbent material and an axial tubular passage, comprising:

an elongated cylindrical insert disposable endwise into one end of the axial passage of the roller cover and being axially movable to a seated position in which an outer end portion of the insert closes said one end of the passage, said insert being of a diameter to slidingly engage the wall of the passage;

a generally cylindrical casing having an internal diameter, less than the outer diameter of said paint roller cover, said casing having top and bottom open ends with each of said open ends being open to a diameter substantially equal to the internal diameter of the casing whereby to enable the roller cover with said insert therein to be received endwise through the open top end, axially moved to a predetermined position in which said closed end of said passage is positioned at the top open end of said casing, and removed endwise through the open bottom end; stop means removably mounted to the bottom end of the casing to maintain the roller cover in said predetermined position; and means removably mounted to the casing for applying a pressurized cleaning fluid to the top end of said casing for guided flow through the outer annular layer of the roller cover and discharge thereof from the bottom end of the casing.

2. Apparatus according to claim 1, in which:

the absorbent material of the surrounding outer annular layer of the roller contains fibers; and upon insertion of the roller cover into said casing, the casing wall coacts with the fibers in a manner to deflect them towards the top open end of the casing into an inclined position which will tend to equalize the axial flow of cleaning fluid within the surrounding absorbent layer.

3. Apparatus according to claim 1, in which:

the means for applying a pressurized cleaning fluid comprises a cap member connected with said top end of said casing; and means for connecting said cap member with a source of pressurized fluid.

4. Apparatus according to claim 1, in which:

the outer end portion of the insert is formed to provide a stopper having a peripherally bevelled wall.

5. Apparatus according to claim 4, in which:

said stopper is separately formed and is attached to a tubular insert portion.

6. Apparatus according to claim 3, in which:

the means for connecting said cap member with a source of pressurized fluid comprises a hose connection fitting.

7. Apparatus according to claim 1, in which:

the casing wall at the bottom open end is provided with circumferentially spaced flow outlet openings.

8. Apparatus according to claim 7 in which:

said flow outlet wall openings are positioned below the lower end of the received roller cover.

9. Apparatus according to claim 1, in which:

said stop means comprises an elongate bar member extending transversely of the bottom end of said casing; and wall slots are positioned to respectively releasably receive the opposite ends of said bar member.

10. Apparatus according to claim 9, in which:

said bar is of generally flat configuration; and said slots are respectively provided with a relatively wide inner portion to seatingly support the bar in a plane at right angles to the longitudinal axis of said casing, and a narrow neck portion opening into the bottom end edge of the casing enabling removal of the bar when transversely rotated into a tilted position.

11. Apparatus according to claim 7, in which:

an elongate bar member is positioned above said wall flow outlet openings, said bar member extending substantially diametrically across said casing, and means for removably supporting the ends of said bar member in said casing wall, whereby to provide an abutment for engaging the inserted end of the roller cover at said predetermined position.

12. Apparatus according to claim 1, in which:

an external circumferential surface sealing member is mounted adjacent the top end of said casing; and the means for applying a pressurized cleaning fluid comprises an elongate cylindrical container having an open end, said container, when disposed in a generally upright position, enabling it to be substantially filled through said open end with a cleaning liquid, receives the top end of the casing in piston relation into said open end, and upon manually forced axial movement of the received top end into the container being operative to force the liquid in the container through the outer annular layer of the cover in said casing.

13. Apparatus according to claim 12, in which:

said cylindrical container has a wall opening inwardly spaced from its open end, for determining the maximum liquid level in said container.

14. Apparatus according to claim 12, in which:

the sealing member is mounted on the outer surface of a cylindrical collar connected to the top end of said casing.

15. The method of cleaning a cylindrical paint roller cover of the type having a surrounding outer annular layer of absorbent material and an axial tubular passage, which comprises the steps of:

longitudinally confining the roller cover between outer and inner walls of an annular open ended longitudinally extending passage formed in a piston-like member;

substantially filling a cylindrical container member having an open end with a cleaning liquid;

inserting an end of the piston-like member into sealing piston-cylinder relation with the open end of the container; and thereafter manually axially moving one of said piston-like member and said container relative to the other in a direction to force cleaning liquid in the container through the annular layer of the cover.

16. The method according to claim 15, in which:

the paint roller cover is confined by being inserted endwise into said piston passage at the end which is to be inserted into the open end of the container so as to deflect fibers of the absorbent cover material generally into an inclined position which will tend to transversely equalize the axial flow of cleaning liquid within the absorbent layer between said outer and inner walls of the annular passage.

17. In combination, cleaning apparatus and a paint roller cover of the type having a surrounding layer of absorbent material and an axial tubular passage, comprising:

an elongate cylindrical insert means positioned within said passage and being operative to close one end of the passage;

a cylindrical casing having open opposite ends and being dimensioned to receive the roller cover and assembled insert as a unit endwise through one of said open ends into a predetermined position with the casing wall being inwardly in surface engagement with the outer surface of the roller cover, and with said one end of the passage adjacent said one end of the casing; stop means removably mounted to the other open end of the casing to maintain the roller cover in said predetermined position; and means having a releasable connection with the casing wall at said one end of said casing for applying a pressurized cleaning liquid to said one end of the casing for guided flow through the surrounding layer of absorbent material of the cover and discharge from the other open end of the casing.

18. Apparatus according to claim 17, in which:

the pressure applying means comprises a cap member threadedly connected with the casing wall at said one end and having a flow conducting fitting for connecting the cap member with a source of pressurized liquid.

19. Apparatus according to claim 17, in which:

the pressure applying means comprises a cylindrical container for a cleaning liquid said container having an upper open end for receiving said one end of the casing into piston-cylinder relation, and upon axially moving the casing into the container being operative to force pressurized liquid from the container through the layer of absorbent material of the cover.

20. Apparatus according to claim 19, in which:

a sealing member is positioned between the coacting piston-cylinder surfaces of the casing and container.

* * * * *